US005349147A

United States Patent [19]

Gallone

[11] Patent Number: 5,349,147

[45] Date of Patent: Sep. 20, 1994

[54] PROTECTION DEVICE AGAINST WATER SPLASHES FOR ELECTRIC SWITCHES AND THE LIKE

[76] Inventor: Cesare Gallone, Via Milano 27, 20010 Cornaredo (MI), Italy

[21] Appl. No.: 93,470

[22] Filed: Jul. 19, 1993

[30] Foreign Application Priority Data

Feb. 26, 1993 [IT] Italy ..... MI93U000159

[51] Int. Cl.[5] ..... H01H 19/06

[52] U.S. Cl. ..... 200/302.3; 200/302.2; 200/339; 200/553

[58] Field of Search ..... 200/302.2, 302.3, 302.1, 200/329, 339, 296, 295, 553, 557, 341, 345; 277/165, 184, 177

[56] References Cited

U.S. PATENT DOCUMENTS

| | | | |
|---|---|---|---|
| 3,772,484 | 11/1973 | Roeser | 200/302.3 X |
| 4,825,023 | 4/1989 | Morse | 200/302.2 |
| 5,053,591 | 10/1991 | Theurer | 200/302.3 X |
| 5,149,924 | 9/1992 | Priesemuth | 200/339 X |

FOREIGN PATENT DOCUMENTS

| | | | |
|---|---|---|---|
| 1186928 | 2/1965 | Fed. Rep. of Germany | 200/302.3 |
| 3538849 | 4/1986 | Fed. Rep. of Germany | 200/302.3 |
| 2478772 | 9/1981 | France | 200/302.2 |

*Primary Examiner*—Glenn T. Barrett
*Attorney, Agent, or Firm*—Kolisch, Hartwell, Dickinson, McCormack & Heuser

[57] ABSTRACT

A water-splash protected electric switch apparatus which includes a casing of electrically insulating material and fixed contacts housed within the casing. A closure wall sealingly closes off the front of the casing. A pair of control push buttons disposed exteriorally of the closure wall are connected to respective ones of a pair of transmission rods that pass through the closure wall to actuate a contact element. The contact element is actuated to establish continuity or to break continuity between fixed contacts within the casing. Guide collars on the closure wall have perimetric walls on the push buttons sealingly associated therewith.

3 Claims, 1 Drawing Sheet

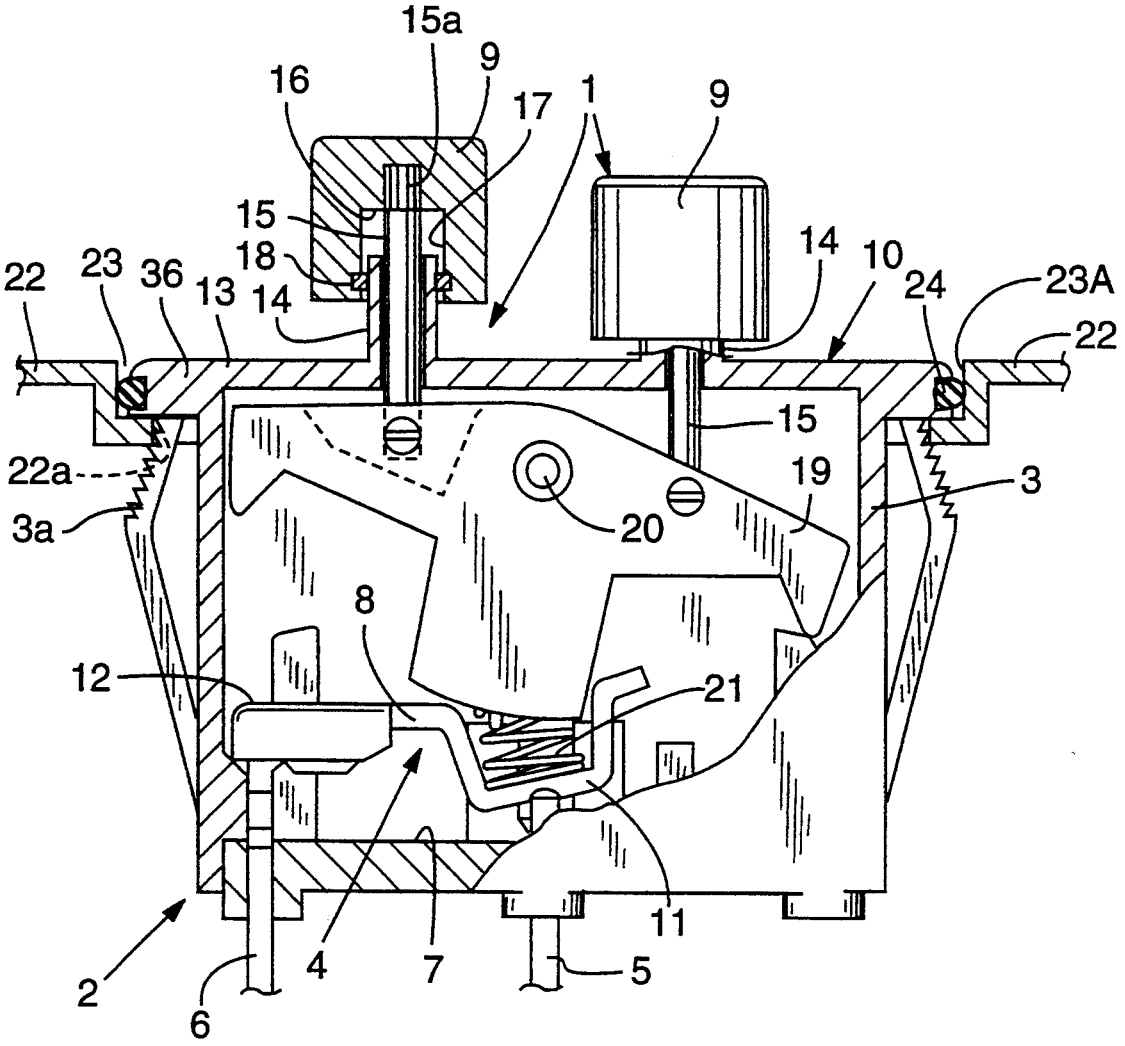
15a
9
16
17
1
9
15
18
14
10
22
23
36
13
14
24
23A
22
15
22a
19
3
3a
20
8
12
21
11
2
4
7
5
6

PROTECTION DEVICE AGAINST WATER SPLASHES FOR ELECTRIC SWITCHES AND THE LIKE

The present invention relates to an electric switch with structure protecting against water splash. The switch normally includes a casing made of electrically insulating material housing fixed contacts and at least one movable contact element selectively movable between an opening condition and a closure condition, in order to respectively break and restore an electric continuity between the fixed contacts. The switch also usually includes at least one control pushbutton projecting externally of a front side of the casing and manually operable for controlling the displacement of the movable contact element between the closure and opening conditions and sealing means acting on the front side of the casing for inhibiting the penetration of external agents into the casing.

In the embodiment described the inventive solution is adopted on a switch of the type to be used mainly on household electrical appliances. It is however understood that the innovatory concepts proposed in the present invention can be also adopted in switches intended for uses other than the above one.

It is known that electric switches and similar switching members of the above type essentially comprise an insulating casing housing at least one pair of fixed contacts each terminating at a respective pole of an electric circuit to which the switch is connected. Housed in the casing is at least one movable contact element that, through a control pushbutton manually operable from the outside, can be moved for selectively opening and closing the electric connection between said fixed contacts.

The foregoing being stated, it is noted that said switches are often associated with apparatus that may accidentally operate or are conceived for use in the presence of water or in highly damp environments, as well as in the presence of other external agents particularly damaging for the correct operation of the switch.

It is apparent that in the absence of appropriate expedients or protection devices, this situation involves many problems in terms of correct operation and safety.

In fact, if even a small amount of water should enter the casing, making the contacts wet, inevitably electric discharges and/or shortcircuits would occur which not only can damage the electric circuit to which the switch is connected but also involve high risks for the safety of the appliance's user.

In order to obviate the above drawbacks, in case of switches destined to appliances intended for use in the presence of liquids or in very damp environments, it has been hitherto provided that sealing means be associated with said switches, which means generally consists of a flexible covering element disposed such as to close the front side of the casing from which the control pushbutton projects.

In greater detail, this flexibile covering element mainly made in silicone or other appropriate material, has a perimetric sealing edge engaged on said front side by an appropriate fastening frame so as to fully insulate the casing and, as a result, all components housed therein, from the surrounding atmosphere.

However this solution is particularly heavy from an economic point of view above all in consideration of the reduced overall costs of the switches of the type in reference.

The covering element made of silicone material actually has a high production cost to which costs for manufacturing the fastening frame must be added, as well as costs resulting from the additional time and operations required during the assembling step for the engagement of the covering element and fastening frame on the casing.

Under this situation, the main object of the invention is substantially to solve the problems of the known art by providing switch with structure protecting against water splashes that has a high operating reliability and can be manufactured at very reduced production costs and installed very easily.

In the specific embodiment herein disclosed, the switch with water splash protection is characterized by a closure wall sealingly associated with the front side of the casing; at least one guide collar projecting externally of the closure wall; at least one transmission rod slidably passing through the guide collar for connecting the control pushbutton to the movable contact element, said control pushbutton having a bottom wall engaged to one end of the transmission rod and a perimetric wall which is sealingly fitted around the guide collar.

BRIEF DESCRIPTION OF THE DRAWING

The drawing comprises a figure showing part interrupted cross-sectional view of a switch apparatus including a switch and structure protecting against water splash in accordance with the invention.

DETAILED DESCRIPTION OF THE PREFERRED EMBODIMENTS

Referring to the figure, a water-splash protected switch apparatus is generally identified by reference numeral 1.

The apparatus has an electric switch 2 and structure for the purpose of inhibiting the penetration of any external agents thereinto.

The switch 2 conventionally comprises a casing 5 made of electrically insulating material and intended for engagement with a shaped opening 22*a* provided in a support wall 22 of any electrical appliance (not shown) with which the switch is to be associated. Suitable resilient tabs 3*a* cooperate with a perimetric projection 3*b* of the casing 3 for fastening the switch 2 to the edge of the shaped opening 22*a*.

Preferably the perimetric projection 3*b* is embedded in a perimetric recess 23 defined around the edges of the shaped opening 22*a*. An annular sealing element 24 engaged around the perimetric projection 3*b* acts between the projection and a locating housing 23*a* defined in the perimetric recess 23, so as to prevent water or other undesired substances from penetrating into the switch through the shaped opening 22*a*.

An interconnecting device 4 operates within the casing 3 for selectively causing the opening and closure of one or more electric circuits with which the switch is associated.

In greater detail, the interconnecting device 4 which is the object of an Italian Patent application filed on same date in the name of the same Applicant, comprises first and second fixed contacts, 5 and 6, rigidly carried by a base wall 7 of the casing 3 and connected to respective electric conductors, not shown as known per se and conventional. The first and second fixed contacts 5 and 6 cooperate with at least one movable contact element 8 that, upon the action of at least one control pushbutton 9 projecting externally of a front side 10 of the casing 9, can be selectively moved from an open condition to a closed condition, for breaking and restoring an electric continuity between the fixed contacts 5 and 6, respectively. More particularly, the movable contact element 8 has a linking portion 11 oscillatably engaged on the first fixed contact 5 and an interconnecting portion 12 which is moved close to and away from the second fixed contact 6 when said opening and closure conditions are respectively set.

In the device in question, a sealing means is provided to be associated with the switch 2 and it operates on the front side 10 of the casing 3 for ensuring a heat insulation of said casing from the surrounding atmosphere.

In accordance with the present invention, this sealing means is such structured that it defines a labyrinth path capable of preventing water droplets projected against the switch 2 from penetrating thereinto. More particularly, the sealing means comprises a closure wall 13 hermetically associated with the front side 10 of the casing 3. The closure wall 13, preferably of one piece construction with the casing 3, has at least one guide collar 14 projecting from the wall itself and slidably passed through by a transmission rod 15 operatively connecting the control pushbutton 9 to the movable contact element 8, as better specified in the following. In particular, still in accordance with the invention, the control pushbutton 9 has a bottom wall 16 engaged to one end 15*a* of the transmission rod 15 and a perimetric wall 17 sealingly fitted around the guide collar 14 possibly through interposition of at least one seal 18.

In the embodiment shown the switch 2 with which the apparatus 1 is associated is of the bat-handle type. In this case two control pushbutton 9 are provided each engaged on a corresponding guide collar 14 and carrying respective transmission rods 15. The rods 15 are linked, on mutually opposite sides, to a rocking element 19 oscillatably engaged with the casing 3 by at least one central pivot pin 20.

The rocking element 19 is operatively connected to the movable contact element 8 via a bistable helical spring 21 acting at the linking portion 11 of the movable contact element. The bistable spring 21, in known manner, bends with alternate motion on opposite sides with respect to an ideal median line, thereby selectively controlling the movement of the movable contact element 8 from the open condition to the closed condition and vice-versa.

The bistable spring 21 acting upon the movable contact element 8 also ensures that the linking portion 11 thereof is constantly held in contact with the end of the first fixed contact 5.

The present invention attains the intended purposes.

The apparatus in fact enables the switch to be satisfactorily protected against water splashes without the use of sealing elements made of silicone or similar materials being required. Actually, in the known art said materials besides encountering problems as regards reliability, also involve important increases in costs due to the particular workings for manufacturing and assembling the different additional parts.

Unlike the solutions of the known art, the present invention can be adopted on all kinds of switches, changover switches or the like, without practically involving any increase in the production costs.

In the connection it is to note that the closure wall 13 can be easily formed during the moulding step for making the casing 3. The transmission rods 15 may also be made, if desired, unitary with the respective control pushbuttons 9 and linked to the rocking element 19 by a mere fitting action to be executed on the automated assembly lines conventionally used for making said switches.

Obviously, many changes and modifications may be made to the invention as conceived without departing from the scope of the appended claims.

It is claimed and desired to secure by Letters Patent:

1. A water-splash protected electric switch apparatus comprising:

a casing of insulating material and fixed contacts housed within the casing and a movable contact element within the casing, movable between opening and closure conditions in order to respectively break and restore electrical continuity between said contacts;

a pair of control push buttons disposed externally of the casing for controlling displacement of the movable contact element;

a sealing structure for preventing external agents from penetrating into the casing;

said sealing structure comprising a closure wall in sealed relation with a front side of the casing, said closure wall having a pair of guide collars projecting externally of the wall;

a pair of transmission rods secured within and mounted for reciprocation within respective ones of said guide collars;

a rocking element within the casing operatively connected to the contact element for controlling movement of the contact element between closure and opening conditions, said transmission rods being operatively connected to said rocking element; and said pair of control push buttons being operatively connected to respective ones of said transmission rods and each push button including a perimetric wall which fits about a guide collar receiving the transmission rod and a seal sealing the perimetric wall to its associated collar.

2. A water-splash protected electric switch apparatus comprising:

a casing made of electrically insulating material having a front side, an interior and a pair of fixed contacts housed within the casing;

a movable contact element movably mounted within the casing movable between opening and closure conditions to respectively break and restore electric continuity between the fixed contacts;

a control push button disposed externally of the front side of the casing for controlling displacement of the movable contact element;

a sealing structure on the front side of the casing for sealing off the interior of the casing from external agents, said sealing structure comprising;

a closing wall sealingly fitted against the front side of the casing;

a guide collar portion integral with the closure wall projecting externally of the closure wall and having an outside surface;

an elongate transmission rod passing through and mounted for reciprocation within the guide collar portion having an inner end operatively connected to the movable contact element;

said push button having a perimetric wall portion which encircles the outside surface of the guide collar portion, the push button and its said wall being relatively reciprocatively mounted for relative motion along a length of said collar portion;

a channel in one of said portions receiving an annular seal with the seal relatively stationary on said one of said portions; and said seal bearing against the other of said portions and producing a seal between the two portions with relative reciprocative motion occurring between the portions.

3. The apparatus of claim 2, which further includes a rocking element rockably mounted within the casing, said transmission rod having a bottom end connected to said rocking element and producing relatively rocking movement of the rocking element with depression of said push button, rocking movement of the rocking element producing movement of said movable contact element.

* * * * *